United States Patent [19]

Wood

[11] Patent Number: 4,718,861

[45] Date of Patent: Jan. 12, 1988

[54] DETACHABLE CABLE STRAIN RELIEF CLAMP

[75] Inventor: Brian J. Wood, Hillsboro, Oreg.

[73] Assignee: Tektronix, Inc., Beaverton, Oreg.

[21] Appl. No.: 877,589

[22] Filed: Jun. 23, 1986

[51] Int. Cl.[4] ..... H01R 9/07; H01R 13/58

[52] U.S. Cl. ..... 439/460; 439/493; 439/498

[58] Field of Search ..... 339/17 F, 103 M, 107, 339/128; 439/457, 458, 469, 460, 492, 493, 498, 499

[56] References Cited

U.S. PATENT DOCUMENTS

| | | | |
|---|---|---|---|
| 3,688,635 | 9/1972 | Fegen | 339/128 X |
| 3,907,396 | 9/1975 | Huber | 339/17 F X |
| 4,065,199 | 12/1977 | Andre et al. | 439/498 |
| 4,157,612 | 6/1979 | Rainal | 439/493 X |
| 4,351,579 | 9/1982 | Kordes et al. | 339/17 F X |
| 4,639,054 | 1/1987 | Kersbergen | 439/465 X |

*Primary Examiner*—Eugene F. Desmond

*Attorney, Agent, or Firm*—Allston L. Jones; Robert S. Hulse

[57] ABSTRACT

A cable strain relief clamp assembly to securely hold a bundle of flat cables while providing quick assembly/-disassembly from the main unit chassis. Identical clamp halves are positioned and fastened at a specified location on the cable bundle. The clamp (with the attached cable) is then snapped onto a bracket to become a subassembly unit. The bracket mates with the main unit chassis utilizing a snap fit detail oriented perpendicular to typical cable axial forces, thus fixing the cables in place. Accommodating varied thicknesses and numbers of cables can be accomplished by varying the aperture of the clamp. The clamp may also provide an electrical ground path between cable and chassis. Other features of the present invention are that: (1) multiple cables and varied widths can be accomplished; (2) it can be detached from main unit chassis without use of fasteners; (3) it does not depend on termination of the cables in male/female relationship; and (4) a consistent part outline is provided for all applications.

3 Claims, 5 Drawing Figures

DETACHABLE CABLE STRAIN RELIEF CLAMP

CROSS REFERENCE

This application is related to application Ser. No. 877,592, entitled "MODULARIZED ELECTRONIC INSTRUMENT PACKAGING SYSTEM" by the same inventor, which was filed on the same day as this application.

BACKGROUND AND SUMMARY OF THE INVENTION

This invention relates to strain relief for flex cables. In particular, the present invention relates to strain relief clamps for a plurality of flex cables stacked one on the other.

In an effort to miniturize electronic packaging and cabling, flex cables are increasingly utilized. To further facilitate miniturization of electronic packaging, flex cables are stacked one above the other with their ends staggered so that the connectors on their ends are parallel to each other.

In the prior art, numerous flex cable strain relief techniques have been utilized. Each design usually consists of a large number of parts with a different design necessary where more than one flex cable is bundled together with others and where strain relief is needed at the end of a cable or where the cables pass through the outer shell of an electronics device. FIG. 5 shows a prior art strain relief clamping system for flex cables wherein each cable must be placed between separate clamp parts.

It is desirable to have a flex cable strain relief clamp that requires a minimum number of different parts that can be quickly assembled/disassembled thus saving assembly time while minimizing damage to the cables and can be utilized in any application where a flex cable strain relief clamp is necessary. The present invention offers such a device.

In accordance with the illustrated embodiments of the present invention, the present invention provides a cable clamp assembly disposed to provide strain relief for a stack of, or a single flat cable, by means of a cable clamp that has universal application to chassis mounting as well as end of cable mounting external to an instrument chassis. This is accomplished through the use of two identical clamp halves with an aperture through the assembly when the two clamp halves are placed in opposing relationship to each other. The dimensions of the aperture are such that it is at least as wide as the width of, and no higher than the height of, the stack of flat cables. Each of the clamp halves also defines means at each end for mounting the assembled clamp perpendicular to normal cable forces. BRIEF DESCRIPTION OF DRAWINGS FIG. 1 is an exploded perspective view of the flex cable strain relief clamp of the present invention.

DETAILED DESCRIPTION OF THE PREFERRED EMBODIMENT

Figure 1:
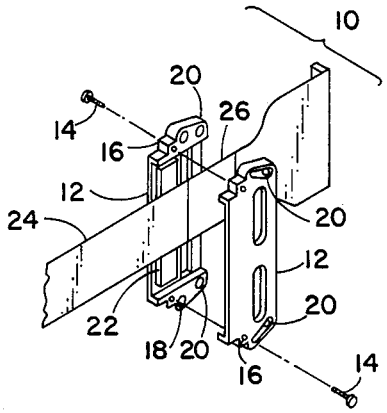

In FIG. 1 there is shown a cable clamp 10 of the present invention. Clamp 10 includes two identical clamp halves 12 that define an aperture 22 through which flex cable 24 passes and is captured. The two clamp halves 12 are fastened together with screws 14 each passing through hole 16 in one of clamp halves 12 and threading into tapped hole 18 of the other of the clamp halves 12.

In FIG. 1 a single flex cable 24 is shown within clamp 10. To accommodate various widths of flex cables 24 or a plurality of flex cables 24 stacked one above the other (see FIG. 2) the configuration of the aperture 22 molded within each of clamp halves 12 is modified to accommodate the thickness of the stack. The clamp 10 can also be used to ground a shield 26 around flex cable 24 by metalizing clamp halves 12 and connecting clamp 10 to the chassis of the electronic device by means of mounting snap fasteners 28 (see FIG. 2). For the universality of clamp 10, the external configuration and size remains unchanged, while aperture 22 within each clamp half 12 may be less than the full width permitted by clamp half 12 to accommodate narrower flex cables as in FIG. 1.

Figure 2:
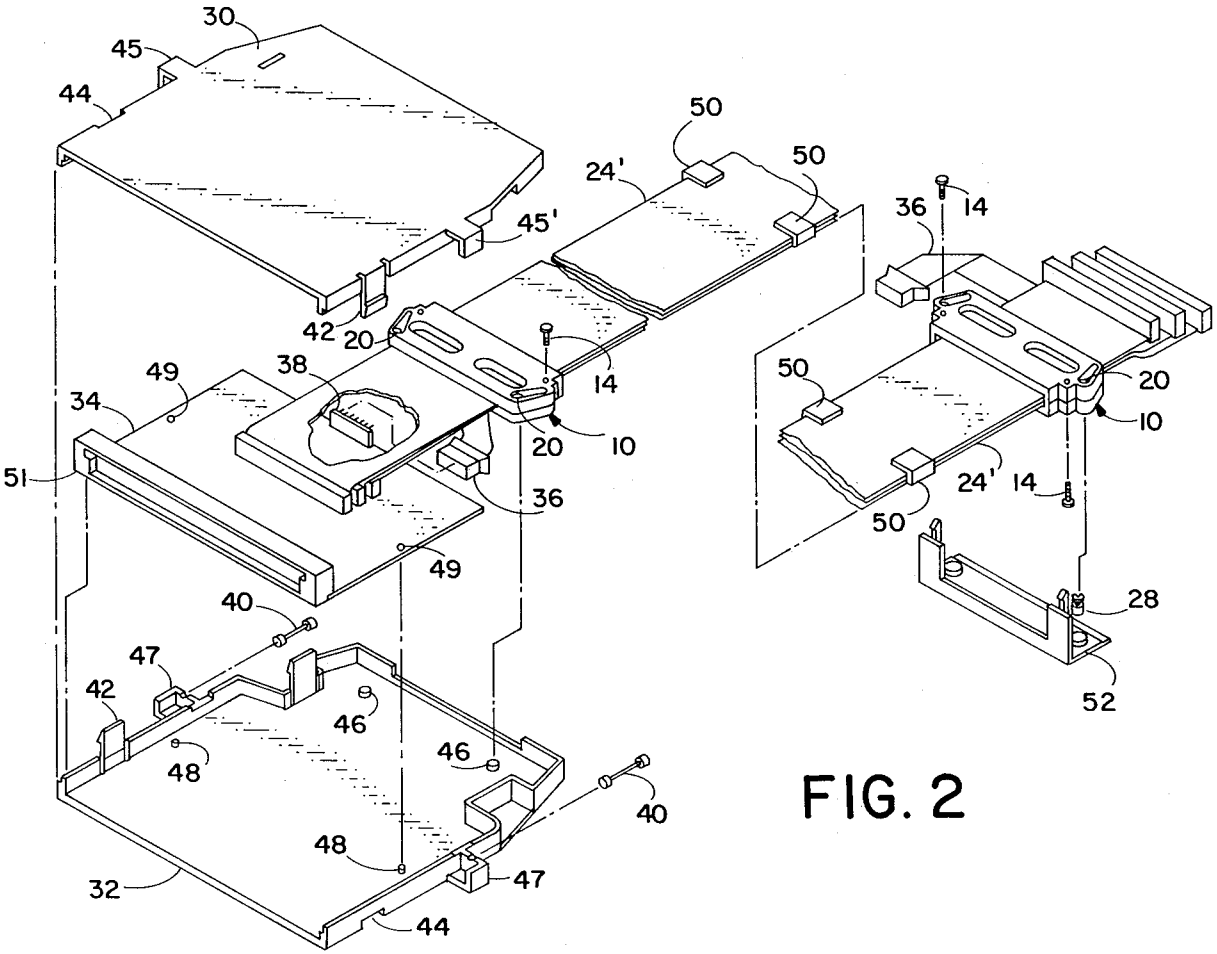
FIG. 2 is an exploded perspective view of two ends of a bundle of flex cables with the present invention utilized at both ends.

A cable end adapter and a chassis mount application of cable clamp 10 is shown in exploded view in FIG. 2 at opposite ends of a flex cable 24'. Flex cable 24' consists of three full width signal flex cables and a narrow power cable 36. Intermediate the two ends of flex cable 24', clips 50 are used to maintain the individual flex cables in alignment one above the other.

To the left in FIG. 2, a cable end adapter is illustrated. The adapter consists of three major components and several screws or other fasteners. It's major components are top housing 30, bottom housing 32 and a connector adapter 34. Connector adapter 34 is mounted to the bottom housing 32 by means of screws or other fasteners (not shown) by means of holes 48 and 49. Cable clamp 10 is mounted to bottom housing 32 by snapping holes 20 onto snap fasteners 28 (shown with chassis bracket 52 at right in FIG. 2) screwed into tapped holes 46 in bottom housing 32. The connectors on the ends of cables 24' are then mated with the connectors on connector adapter 34, including power cable connector 36 being mated to connector 38. Connector 51 at the other end of connector adapter 34 is shown as a connector for mating with an edge of an electronic circuit board or the like. To complete the assembly of the cable end adapter, top housing 30 is placed over the assemblage of bottom housing 32, cable clamp 10 and connector adapter 34 with snap fingers 42 passing through and being captured by slots 44, and fingers 45 extending into ears 47. Screws 40 are then threaded through a hole (not shown) in ears 47 to capture fingers 45 therein.

To the right in FIG. 2 the opposite end of cable 24' is shown being attached to a chassis bracket 52. The method of attaching bracket 52 to the chassis of an instrument will be shown in and discussed in relation to FIGS. 3 and 4 below. Here cable clamp 10 is assembled around cable 24' near its other end and then snapped to chassis bracket 52 by snap fasteners 28 which are screwed into bracket 52. The connectors on the end of the individual flex cables that make up cable 24' are then affixed to mating connectors (not shown) within the instrument.

Figure 3:
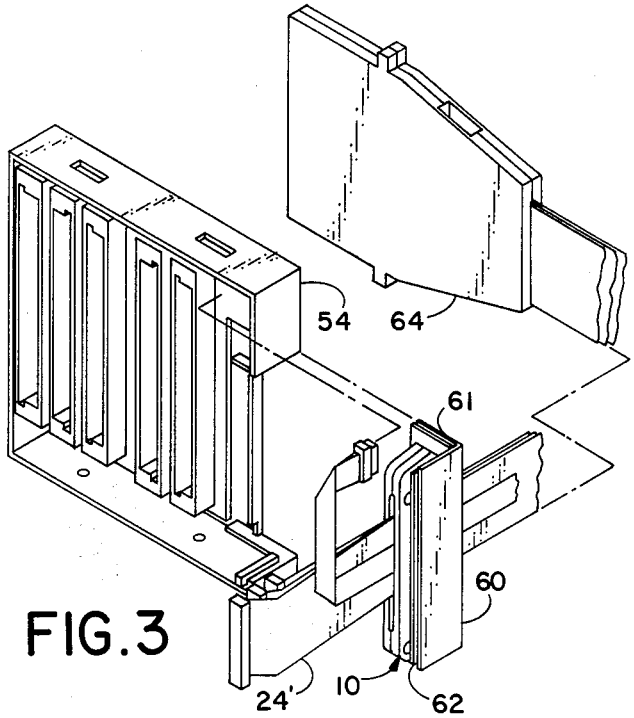
FIGS. 3 and 4 are exploded perspective views further illustrating the use of the strain relief clamps for flex circuits of the present invention.

FIG. 3 shows a cable 24' like that of FIG. 2 being connected to a chassis back 54 of an instrument. Cable clamp 10 is affixed to a slip-in chassis bracket 60 in the same manner as with chassis bracket 52 in FIG. 2. Chassis bracket 60 slips onto chassis back 54 by means of slots 61 on the top and bottom of bracket 60 and mating flanges (not shown) on chassis back 54. The side panel of the instrument (not shown) then slips into slot 62 of chassis bracket 60 to retain it in place.

Figure 4:
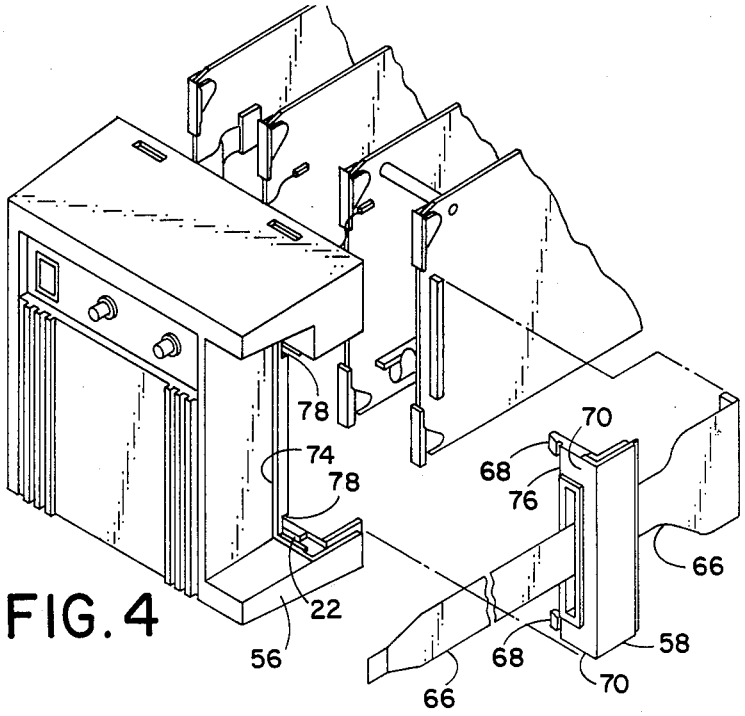
Figure 5:
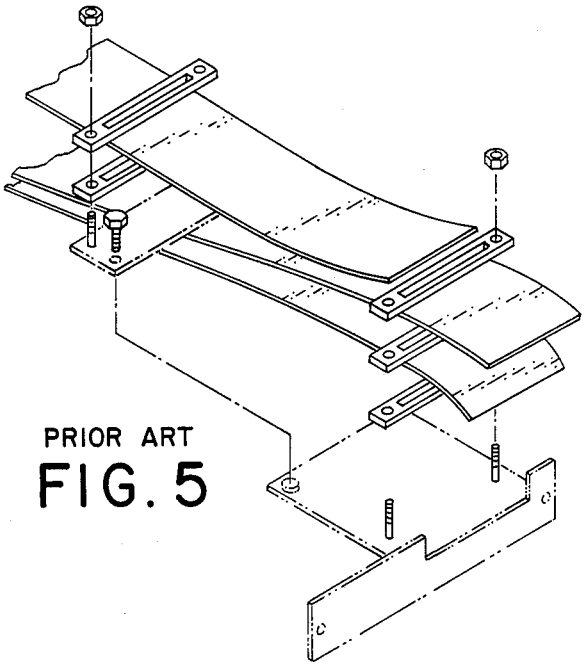
PRIOR ART FIG. 5
FIG. 5 is an exploded perspective view of a flex cable strain relief clamping system of the prior art.

Similarly, FIG. 4 shows a chassis bracket 58 having snap fingers 68. Chassis bracket 58, with cable clamp 10 containing probe cable 66 mounted thereto as discussed above, slides into chassis front 56 with top and bottom edges 70 in slots 72 with edge 76 seating in slot 74 as snap fingers 68 extend through and snap behind notches 78.

In each of the applications shown in the Figures, whether at the end of a flex cable or where the cable is passing into or out of a chassis, the same cable clamp 10 consisting of two identical halves can be utilized. In each application, cable clamp 10 snaps in place with the snap fitting oriented perpendicular to the normal cable axial forces, thus fixing the cable in place. The strain relief cable clamp of the present invention has a consistent part outline in all applications and does not depend on the cables being terminated in a male/female relationship as in many of the prior art clamps.

While this invention has been described in terms of a single embodiment, it is contemplated that persons reading the preceding descriptions and studying the drawings will realize various alterations and modifications thereof. It is therefore intended that the following appended claims be interpreted as including all such alterations and modifications as fall within the true spirit and scope of the present invention.

What is claimed is:

1. A cable clamp assembly disposed for providing strain relief for at least one flat cable of an electronic instrument, said assembly comprising:

two identical clamp halves defining an aperture through the assembly when the two clamp halves are placed in opposing relationship to each other for capturing the stack of said at least one flat cables, said aperture having an outline that complements the various widths of said at least one flat cable, each of said clamp halves also defining means for mounting the clamp assembly at each end of the assembled clamp perpendicular to the normal cable forces;

means for fastening said two clamp halves together;

a pair of snap fasteners disposed to be captured by the mounting means at each end of the assembled clamp and disposed to be mounted to a fixable mechanical portion of the electronic instrument; and a chassis bracket attachable to the electronic instrument disposed to capture said snap fasteners to provide strain relief to said at least one stacked flat cable as they pass through the chassis wall of the electronic instrument, said chassis bracket defines at least one of a groove and tongue around its perimeter where the chassis bracket attaches to said electronic instrument, with the electronic instrument having complementary mating surfaces to capture said chassis bracket in tongue and groove fashion.

2. A cable clamp assembly disposed for providing strain relief for at least one flat cable of various widths stacked one above the other in association with an electronic instrument, said assembly comprising:

two identical clamp halves defining an aperture through the assembly when the two clamp halves are placed in opposing relationship to each other for capturing the stack of said at least one flat cables, said aperture having an outline that complements the various widths of said at least one flat cable, each of said clamp halves also defining means for mounting the clamp assembly at each end of the assembled clamp perpendicular to the normal cable forces;

means for fastening said two clamp halves together;

a pair of snap fasteners disposed to be captured by the mounting means at each end of the assembled clamp and disposed to be mounted to a fixable mechanical portion of the electronic instrument; and a chassis bracket attachable to the electronic instrument disposed to capture said snap fasteners to provide strain relief to said at least one stacked flat cable as they pass through the chassis wall of the electronic instrument, said chassis bracket defines at least one of a snap finger means and slot on its perimeter where the chassis bracket attaches to said electronic instrument, with the electronic instrument having complementary mating surfaces to snappingly capture said chassis bracket.

3. A cable clamp assembly disposed for providing strain relief for at least one flat cable of various widths stacked one above the other in association with an electronic instrument, said assembly comprising:

two identical clamp halves defining an aperture through the assembly when the two clamp halves are placed in opposing relationship to each other for capturing the stack of said at least one flat cables, said aperture having an outline that complements the various widths of said at least one flat cable, each of said clamp halves also defining means for mounting the clamp assembly at each end of the assembled clamp perpendicular to the normal cable forces;

means for fastening said two clamp halves together;

a pair of snap fasteners disposed to be captured by the mounting means at each end of the assembled clamp and disposed to be mounted to a fixable mechanical portion of the electronic instrument; and a cable end adapter means disposed to capture said snap fasteners for providing strain relief to said at least one flat cable and for adapting said cables to be interconnectable with another circuit element outside said electronic instrument, with each flat cable having a connector affixed thereto at at least one end wherein said cable end adapter means includes: a connector adapter having:

a plurality of mating connectors disposed to mate with said connectors on the same end of each of said flat cables;

second connector means electrically coupled to said plurality of mating connectors for providing a desired other connector configuration;

bottom housing means for receiving said connector adapter and said snap fasteners; and top housing means for closing on said bottom housing means to enclose therein said connector adapter and said assembled two clamp halves.

* * * * *